US005570926A

United States Patent [19]

Papiernik et al.

[11] Patent Number: 5,570,926

[45] Date of Patent: Nov. 5, 1996

[54] COLLAPSIBLE EASYCHAIR

[75] Inventors: Elie Papiernik, Paris; Yann Le Gal, Voreppe, both of France

[73] Assignee: Lafuma S.A., France

[21] Appl. No.: 494,601

[22] Filed: Jun. 23, 1995

[30] Foreign Application Priority Data

Jun. 30, 1994 [FR] France ..... 94 08312

[51] Int. Cl.[6] ..... A47C 4/50; A47D 1/02

[52] U.S. Cl. ..... 297/39; 297/27; 297/28; 297/30

[58] Field of Search ..... 297/39, 27, 28, 297/30, 46, 47, 16.1, 68, 83, 84

[56] References Cited

U.S. PATENT DOCUMENTS

| | | | |
|---|---|---|---|
| 388,350 | 8/1888 | Eshleman | 297/27 |
| 532,676 | 1/1895 | Lovejoy | 297/27 |
| 1,860,867 | 5/1932 | Matthews | 297/39 X |
| 1,952,296 | 3/1934 | Taylor | 297/30 X |
| 2,195,091 | 3/1940 | Lorenz et al. . | |
| 2,649,138 | 8/1953 | Rechler | 297/39 X |
| 2,710,645 | 6/1955 | Luckhardt | 297/30 X |
| 3,037,811 | 6/1962 | Vanderminden | 297/39 X |
| 3,094,358 | 6/1963 | Hartman | 297/39 |
| 3,099,478 | 7/1963 | Pearlstine | 297/28 |
| 5,464,270 | 11/1995 | Chang | 297/39 X |

FOREIGN PATENT DOCUMENTS

| | | | |
|---|---|---|---|
| 136211 | 2/1950 | Australia | 297/39 |
| 4923371 | 4/1953 | Canada | 297/28 |
| 285079 | 1/1965 | Netherlands | 297/30 |
| 693774 | 7/1953 | United Kingdom | 297/39 |

*Primary Examiner*—Peter M. Cuomo
*Assistant Examiner*—Rodney B. White
*Attorney, Agent, or Firm*—Harris Beach & Wilcox, LLP

[57] ABSTRACT

An easychair having a frame which forms the back of the chair, two side members forming the seat of the chair and a pair of spaced apart arm rests. The side members and arm rests are mounted or articulated upon the frame. A U-shaped frame forms the leg rest of the chair and the base is formed by a pair of leg units that are secured to the side members and which articulate about a forked yoke. Each arm rest contains a slide rod in parallel alignment with the side members. The end of the front leg unit is arranged to slide along the slide rod and a locking means for holding the chair in an unfolded position. The legs of the leg units are connected by a linkage so that they move together as the chair is folded and unfolded.

6 Claims, 5 Drawing Sheets

COLLAPSIBLE EASYCHAIR

TECHNICAL FIELD

The invention relates to an easychair, more specifically to an easychair of the type comprising a back and a legrest which can both be inclined and folded flat so as to make the chair easier to carry and store away.

PRIOR ART

This type of chair is widely used outside (in the garden, camping, etc.) or to provide extra seating. It is unnecessary to describe it in detail.

These chairs are generally made up of a base which cooperates with three elements, namely a back, a seat and a legrest, with a piece of fabric being stretched over these elements. The articulation mechanism means that inclining the back brings about a similar inclination of the foot rest, so that when the chair is inclined in the lying down position this enables the legs to be raised for greater comfort (see, for example, Document U.S. Pat. No. 2,195,091).

However, in this version, the armrest is rigidly fixed to the base and the transmission of the movement between the back and the legrest takes place via a sliding tube underneath the armrest, sometimes also known as the elbowrest. The result is that the armrest remains stationary irrespective of the inclination of the seat and does not follow the user's arm into this inclination. This disadvantage does nothing to increase comfort. In addition, the mechanical articulations commonly chosen are bulky and folding the chair flat and setting it up again is difficult, especially for children, since numerous manipulations are required. In the areas around the articulation points these manipulations can even be dangerous and can lead to trapped fingers.

In one embodiment widely employed by the Applicant, the top end of the bases is secured to a sliding tube underneath the armrest, whose position is adjusted by means of an adjustment screw. However, this version has the disadvantage of having the locking member in a position which is difficult to access and which varies with respect to the user according to the inclination of the seat. In addition, actuating the locking member and inclining the chair cannot take place in one and the same movement.

The invention palliates these disadvantages. It aims to provide a fold-away easychair of the type in question, which is easy to set up and fold flat, even for children, does not involve the risk of trapped fingers and is easy to lock into position and is sure to be comfortable.

SUMMARY OF THE INVENTION

Generally speaking, the invention relates to an easychair of the type comprising:

a frame forming the back;

two parallel side members forming the seat which are articulated in the vicinity of the lower end of the back frame;

two armrests which are parallel with each other and with the side members of the seat and are articulated to the back frame;

a U-shaped frame forming the legrest, the two branches of the U being articulated to the ends of the side members and having a piece of fabric stretched over them, the fabric being fastened to the frame and to the side members by elastic means; and a base formed by two leg units, a front leg unit and a rear leg unit respectively, each leg unit being formed by two parallel legs secured to the side members, said leg units being articulated together about a forked yoke;

wherein:

each armrest has a sliding rod which is parallel with the side members;

the end of each front leg unit has a forked yoke designed to slide along said sliding rod, and a means for locking the chair into position;

the legs of the leg units are connected together by an articulated link which is attached to the front leg unit and to a forked yoke fixed on the rear end of the side member, and is designed to allow each rear leg unit to slide;

and lastly, the top ends of the branches of the legrest frame are articulated to the ends of the armrests.

In other words, the transmission of the movement between the back and the legrest takes place by deforming the quadrilateral formed by the back, the legrest, the side members of the seat and the sliding rod of the armrest. During this movement, the entire base is stationary, in particular the sliding forked yoke and the forked yoke located to the rear of the side member, so that the armrest moves at the same time as the back, whereby it follows that, in contrast to the prior art, the armrest follows the inclination movement.

Thus the combination of these characteristics contributes to a novel and sought after result, namely the translation of the armrests at the same time as the inclination of the back and of the legrest, thereby contributing to enhanced comfort.

In an esthetic and more comfortable embodiment, the frame forming the back is closed and ergonomically curved.

Advantageously, in practice:

the side members and the frames are made of tubular metal;

the leg units follow the shape of a U pointing upward and the connecting portion has shoes; in other words, the two front legs and the two rear legs of the chair are connected together, thereby increasing its stability;

the characteristic sliding forked yokes are made of plastic, in particular of polyacetal or of polyamide;

the member for locking the chair into position is an eccentric-type cam.

In a practical embodiment, the articulation via which the branches of the legrest are articulated to the ends of the armrests is formed by a hinge joint consisting:

of a first hinge joint proper in which the end of the sliding rod of the armrest engages;

and of a second hinge joint, generally pointing inward, in which the end of the legrest engages, these two hinge joints being articulated about the same transverse pin.

BRIEF DESCRIPTION OF THE DRAWINGS

The way in which the invention can be implemented and the advantages deriving therefrom will appear more clearly from the embodiment example which follows and which is supported by the appended figures.

EMBODIMENT OF THE INVENTION

Figure 1:
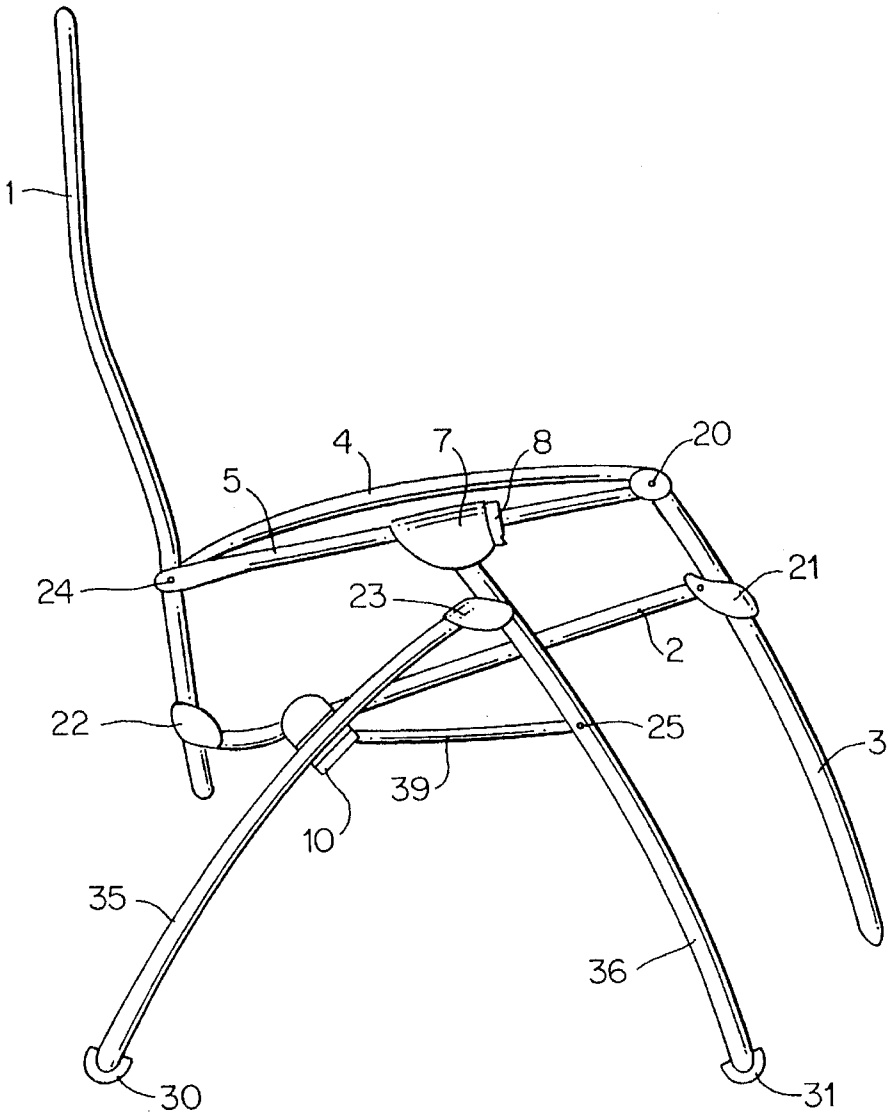
FIG. 1 is a side view of the chair in the setup position.

The chair, as shown in the set-up position in FIG. 1, can be split up into two assemblies having distinct functions, namely, on the one hand, a base made up of two leg units (35, 36) articulated trestle-fashion at connecting forked yoke (23) and, on the other hand, an assembly designed to accommodate a seated person and made up of a back (1), a seat (2), a legrest (3) and two armrests (4).

The back (1) is a closed frame, generally rectangular in shape, and is slightly curved so as to follow the curve of the spine.

The seat side members (2) are each made of tubular metal and hinged at the rear at (22) on the vertical side of the back (1). The articulation is formed close to the lower end of the side of the back (1), by means of a conventional forked yoke (22) in the shape of a U, the base of which accommodates the side member (2) and is welded to it, and the branches of which support a pin which passes through the side of the back (1). These side members (2) are inclined slightly backward.

The two armrests (4) are articulated on the one hand to the back (1) and on the other hand to the legrest (3) at (24) and at (20) respectively. They are basically parallel to the side members (2). Underneath its lower face, each armrest (4) comprises a sliding rod (5) which is designed to move in translation within the forked yoke (7) which is secured to the upper end of the front leg unit (36) of the base.

The legrest is formed by a U-shaped frame which is connected to the seat side members (2) and to the armrests (4). The articulation with the armrests (4) is formed (see FIG. 4) by means of hinge joints (20) connecting the ends of the armrests (4) and the ends of the legrest frame (3). The link between the legrest (3) and the side members (2) is effected by virtue of a conventional forked yoke (21) which is positioned at a height such that the parallel alignment between the armrests (4) and the side members (2) is maintained.

The surface produced firstly by the back (1), secondly by the seat side members (2) and lastly by that part of the legrest (3) located beneath the forked yokes (21), has a piece of fabric 60 stretched over it. In a known manner, this fabric is fastened to these elements by an elastic cord 62 which passes alternately through eyelets in the fabric and through metal loops welded to said elements.

The base is made up of two U-shaped leg units (35, 36). The two ends of the rear leg unit comprise welded forked yokes (23) in which the top parts of the front leg unit (36) are articulated.

In addition, approximately halfway up the front leg unit (36), there is a link (39) which is articulated about the pin (25) and designed to pivot in a vertical plane. The other end of this link is articulated on the guiding forked yoke (10).

In a conventional manner, the horizontal connecting parts of the leg units (35, 36) are fitted with nonskid shoes (30, 31).

The base and the seat have two points of contact, namely, on the one hand the forked yoke (10) and on the other hand the sliding forked yoke (7). The forked yoke (10) is secured to the seat side member (2) and enables the leg unit (35) to slide with respect to this side member (2). The sliding forked yoke (7) is fixed to the top end of the front leg unit (36) of the base. It enables the armrest rod (5) to slide with respect to the base.

Figure 4:
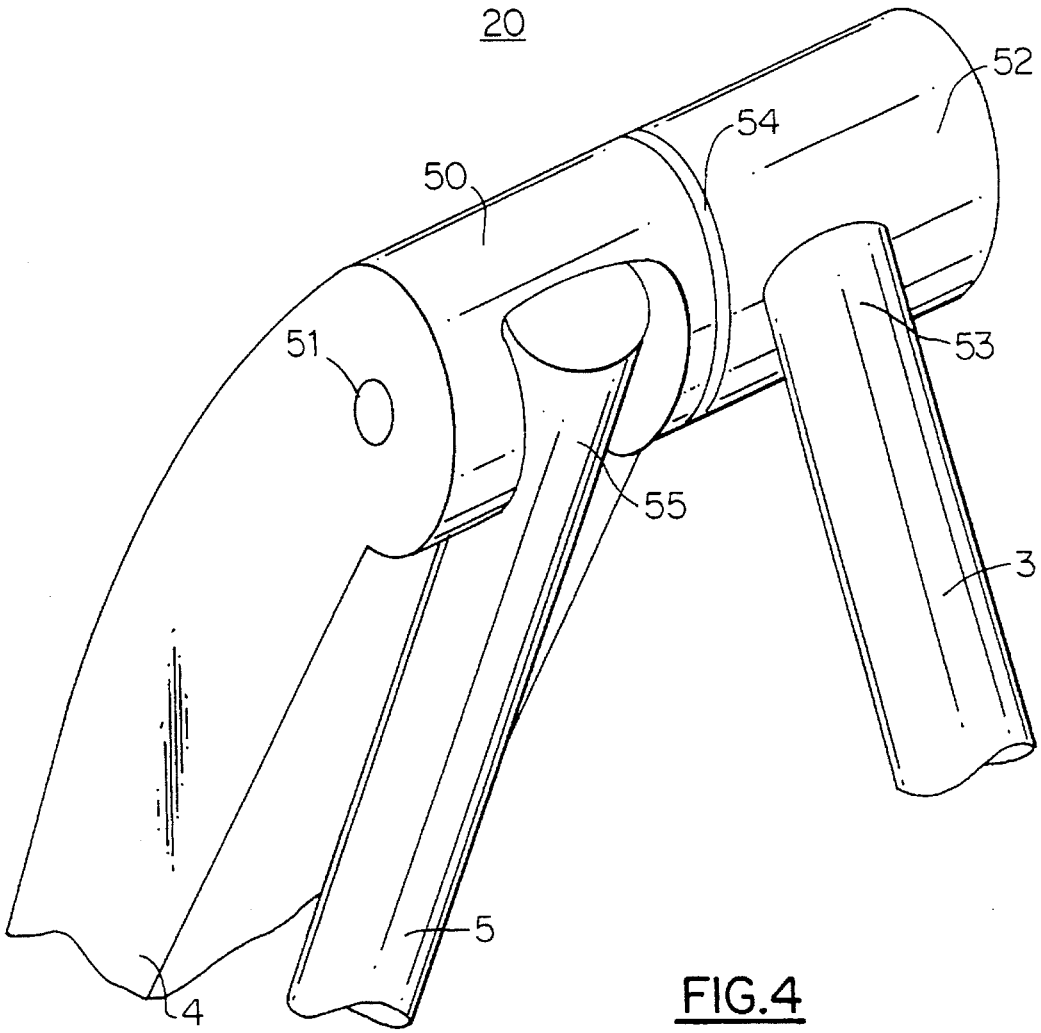
FIG. 4 is a detail view of the articulation between the legrest and the armrests.
Figure 5:
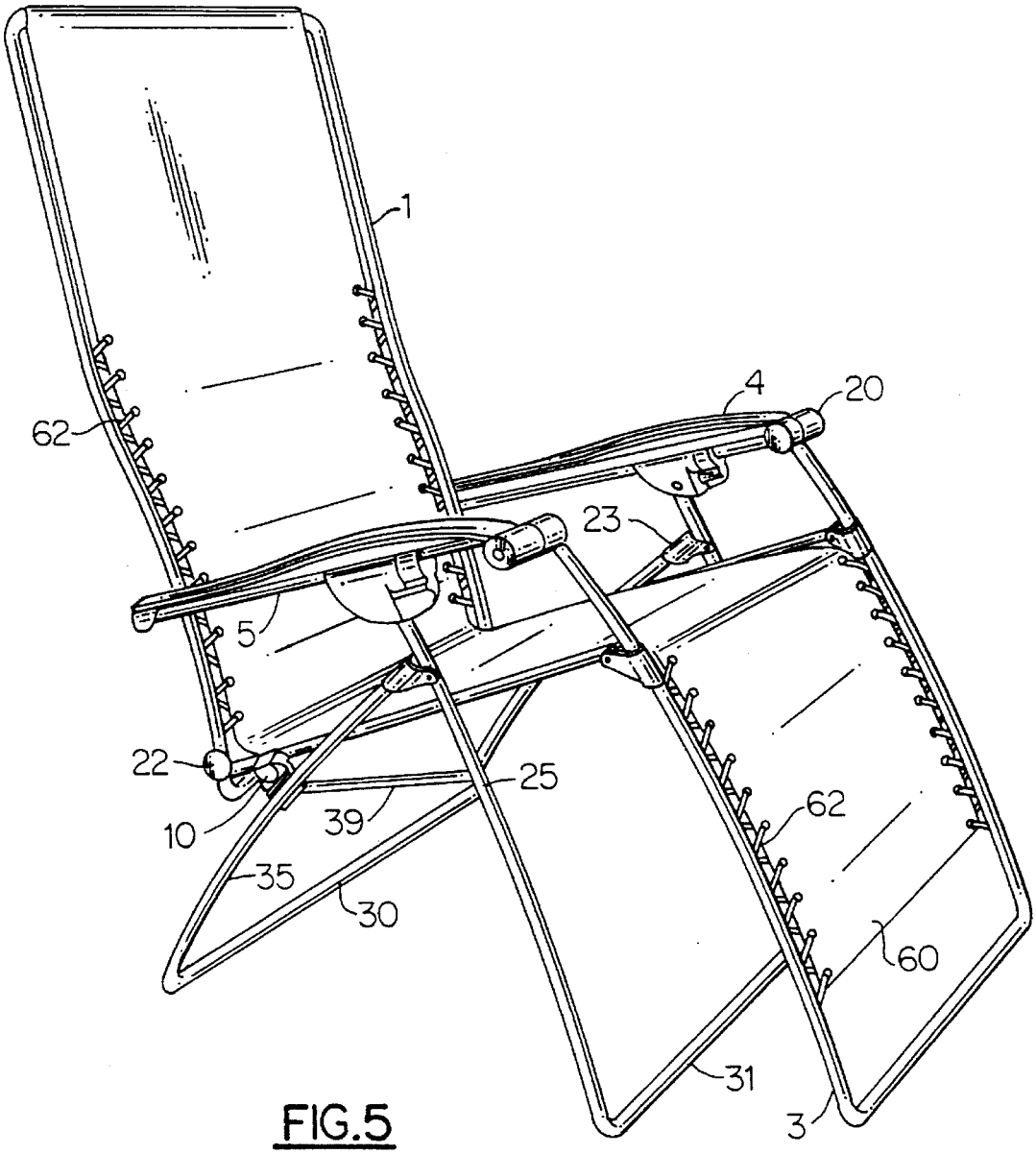
FIG. 5 shows a perspective view of the chair.

The armrest (4) is connected to the legrest (3) by a hinge joint (20), a detail of which is shown in FIG. 4. The sliding rod (5) is housed in the front end of the armrest (4). This cylindrical end (50), having a pin (51) perpendicular to the plane of symmetry of the chair, extends toward the inside of the chair via another cylinder (52) of the same radius which accommodates the upper end (53) of the legrest (3). Thus, hinge (20) includes a first hinge joint (50) in which the end (55) of sliding rod (5) of the armrest engages, and a second hinge joint 52 in which the end (53) of the legrest (3) engages. The pivoting movement between these two pivoting cylinders about the same axis can be provided by a friction washer (54). In a variant embodiment, this washer (54) is absent.

The angle of inclination of the chair is maintained by locking the sliding rod (5) in the forked yoke (7), the locking action itself being provided by the eccentric (8). This eccentric (8) is secured to the sliding forked yoke (7) and can pivot about an axis parallel to the sliding axis. This eccentric (8) comprises a hole whose diameter is close to that of the sliding rod (5), but whose center is slightly offset with respect to the pivoting axis.

The area designed to accommodate the person using the chair incorporates a deformable quadrilateral which can be traced between the various articulations of the elements making up this area. The four corners of this quadrilateral are:

the articulation (24) between the back (1) and the armrest (4), the hinge joint (20) providing the articulation between the armrest (4) and the legrest (3), the forked yoke (21) providing the articulation between the legrest and the seat side member (2), and the forked yoke (22) providing the articulation between the back (1) and the seat side member (2).

In this way, when the back is inclined backward, the articulation (24) is located further back than the forked yoke (22). This movement pulls the sliding rod (5) backward while the side member (2), secured to the base, remains stationary. In this manner, the hinge joint (20) moves back with respect to the forked yoke (21) and the legrest (3) is located in a position which approaches the horizontal.

When the back is inclined forward, the deformation of the quadrilateral is reversed.

In other words, as the chair is tilted forward or backward, the base remains stationary and therefore the seat side members (2) do not move either. The two forked yokes (21) and (22) are therefore also stationary points. The back and the legrest therefore pivot about (21) and (22), following the forward or backward movement of the armrest rod (5).

When sliding is allowed, that is to say when the user wishes to change the angle of inclination of the chair, the eccentric is pivoted so that the hole of the eccentric (8) is aligned with the sliding rod. In contrast, when the user wants to lock the angle of inclination of the chair and immobilize it in the chosen position, he makes the eccentric (8) pivot so that the hole no longer coincides with the sliding rod (5). In this way the inside edge of the hole of the eccentric (8) comes into contact with the sliding rod (5) and, as a result of friction, prevents it from sliding.

Figure 2:
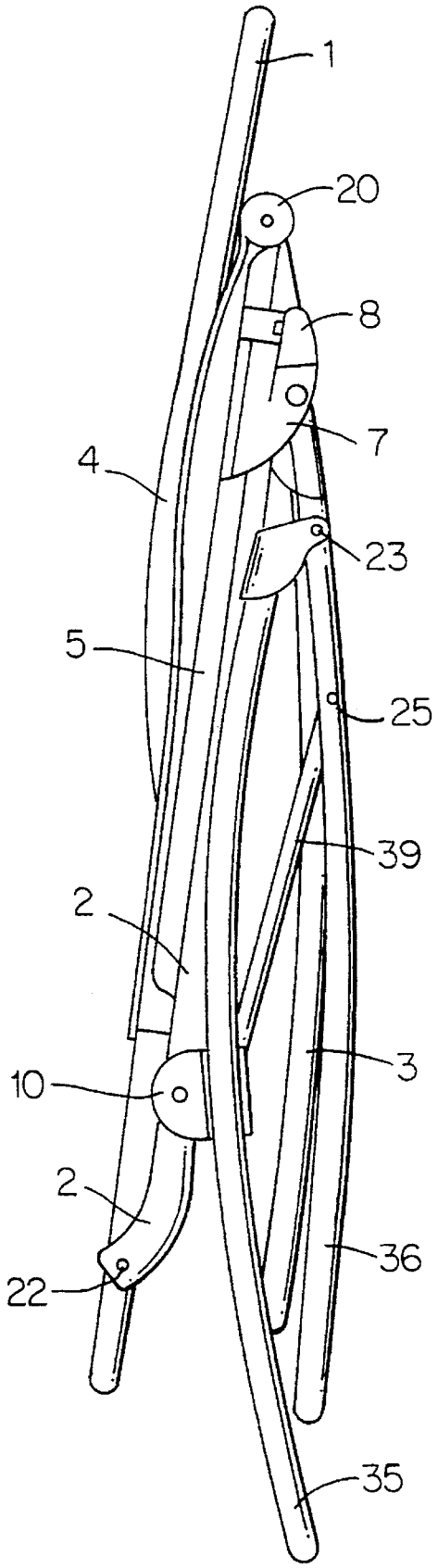
FIG. 2 is a view of the same chair in the folded-flat position.
Figure 3:
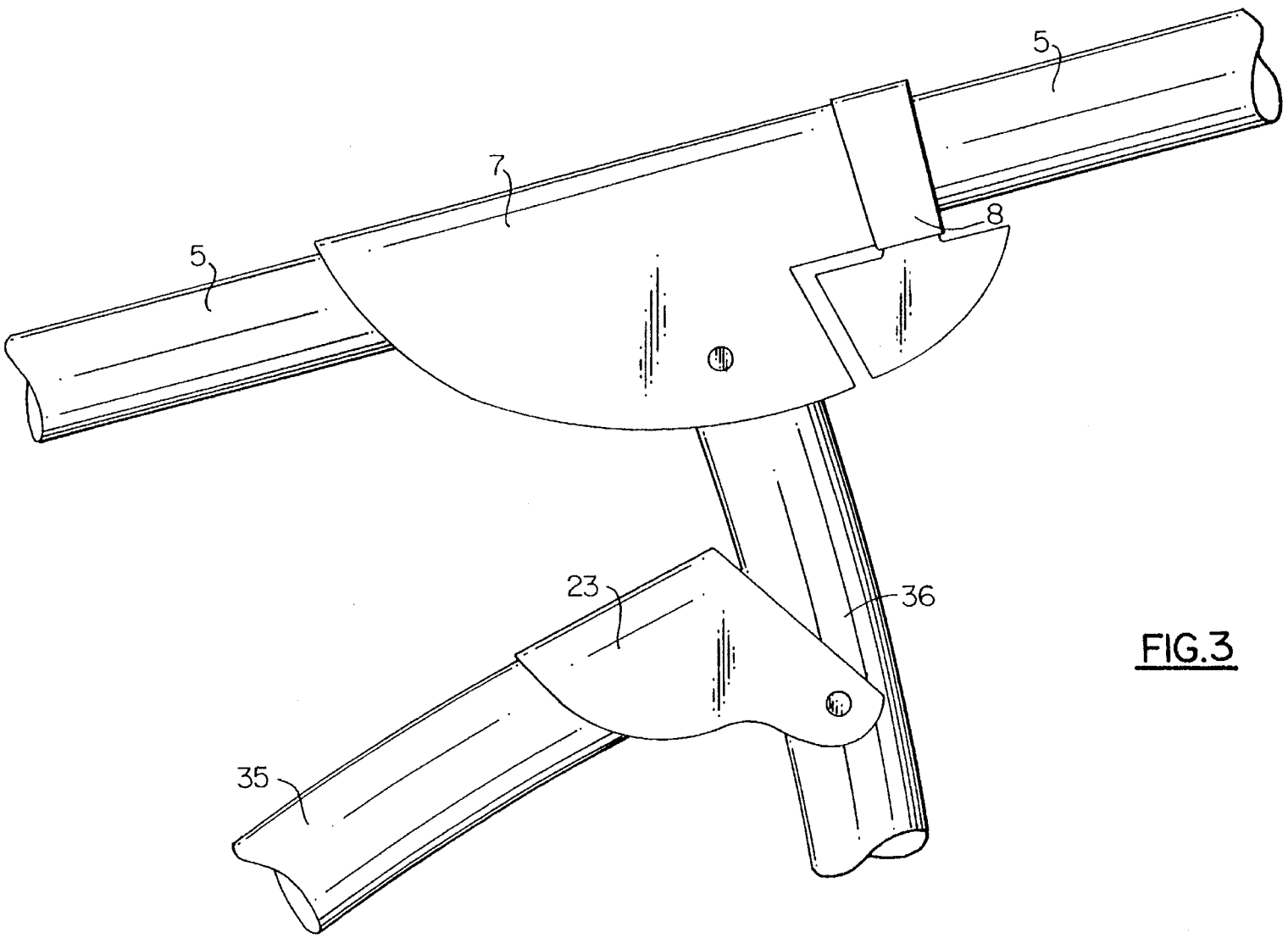
FIG. 3 is a detail view of the sliding member in the region of the armrest.

When it is desired to fold the assembly flat, the rod (5) is left free to slide inside the forked yoke (7). Since the link (39) is articulated about the front leg unit (36) by means of a pivot pin (25), when the two leg units (35) and (36) of the base are folded together, the forked yoke (10) is pushed toward the bottom of the rear leg unit (35). Given that this forked yoke (10) is secured to the seat side member (2), it pulls this member with it in its downward movement. At the same time, the forked yoke (7) is pushed toward the front of the rod (5). Once this forked yoke (7) abuts against the hinge joint (20), the folding movement is continued by the deformation of the quadrilateral described above, with the forked yoke (22) and the hinge joint (20) moving away from each other. Eventually this quadrilateral is completely squashed, with the back (1) being tilted forward and the legrest (3) being tilted backward. The result is illustrated in FIG. 2 which shows the chair folded completely flat.

The chair is set up again by carrying out the above operations in reverse.

One of the advantages of the invention lies in the fact that the armrest is secured to the back. In this way, the person seated can take advantage of the support of the armrest irrespective of the inclination of the seat. In addition, access to the locking member (8) is simple since it is situated directly underneath the cover of the armrest (4).

It emerges from the description of the above example that the invention has several noteworthy advantages, in particular:

on the one hand, the chair can be inclined easily and comfortably. The armrest is always positioned under the user's arm, irrespective of the position of the chair. In addition, locking the chair into position is effected by means of a very simple and efficient movement, by acting on a single component (8) placed close to the user's hand, irrespective of the inclination of the chair;

on the other hand, the simplicity of the operations required to fold this chair flat and set it up again is appreciable. This is on account of the fact that, as a result of the interplay of sliding components, only a single movement is required to fold or unfold the chair.

We claim:

1. An easychair comprising:

a back (1) having a lower end;

a seat having a pair of parallel side members (2), said side members being articulated to said back frame (1) said lower end;

a pair of armrests (4), parallel with each other and with said side members, said pair of armrests (4) articulated to said back frame (1), said each armrest having a sliding rod which is parallel with said side members (2), said each sliding rod having a forward end;

a legrest having a U-shaped frame (3), said U-shaped frame including a pair of braces, each brace having a top end, said each brace's top end articulated to one of said armrests, said each brace further articulated to one of said side members, said legrest, said back, and said seat defining a surface;

a piece of fabric secured to said easychair and disposed across said surface;

a base having a front leg unit (36) and a rear leg unit (35), each leg unit being formed by parallel legs, said each front leg having an end, said front and rear leg units being articulated together about a connecting forked yoke (23), said each front leg end terminating in a sliding forked yoke (7) configured to slide along said sliding rod;

a pair of guiding forked yokes (10), each being fixed to one of said side members (2) toward a rear end thereof, each guiding forked yoke slidably engaging one of said rear legs of said rear leg unit; and a pair of links (39), each having a first end attached to one of said front legs of said front leg unit (36), and a second end attached to one of said guiding forked yokes so that said guiding forked yoke slides downward on one of said rear legs away from said connecting forked yoke, and said sliding forked yoke slides toward said forward end of said sliding rod, when said front and rear leg units are urged together.

2. The easychair of claim 1, wherein said back is closed and curved.

3. The easychair of claim 1, wherein said side members (2) and said frames (1, 3) are made from tubular metal.

4. The easychair of claim 1, wherein said leg units (35, 36) are U-shaped.

5. The easychair of claim 1, wherein said sliding forked yokes (7) are made of polyacetal.

6. The easychair of claim 1, wherein said armrests (4) and said legrest (3) are articulated together with a hinge (20), said hinge comprising a first hinge joint (5) in which an end (55) of said sliding rod (50) engages, and a second hinge joint (52) in which an end (53) of said legrest (3) engages.

* * * * *